US008196325B2

(12) United States Patent
Pitcher et al.

(10) Patent No.: US 8,196,325 B2
(45) Date of Patent: Jun. 12, 2012

(54) FRONT LOADING FRAME DISPLAY ARRANGEMENT

(75) Inventors: David E. Pitcher, Swampscott, MA (US); Thomas P. Burrous, Haverhill, MA (US); Rebecca C. Suciu, Lynn, MA (US); Paul P. Ellsworth, Burlington, MA (US); Alan L. Stenfors, Scituate, MA (US); Sidney Rose, Marblehead, MA (US)

(73) Assignee: Rose Displays, Ltd, Salem, MA (US)

( * ) Notice: Subject to any disclaimer, the term of this patent is extended or adjusted under 35 U.S.C. 154(b) by 185 days.

(21) Appl. No.: 12/660,931

(22) Filed: Mar. 8, 2010

(65) Prior Publication Data

US 2010/0263251 A1 Oct. 21, 2010

(51) Int. Cl.

| | |
|---|---|
| ***G09F 3/20*** | (2006.01) |
| ***G09F 7/00*** | (2006.01) |
| ***A47G 1/06*** | (2006.01) |
| ***A47G 1/16*** | (2006.01) |

(52) U.S. Cl. ..... 40/658; 40/777; 40/361; 40/790; 40/791; 40/792; 40/793; 40/647; 40/611.01; 40/611.02; 40/611.11; 40/611.12; 248/229.1; 248/316.1; 248/316.7; 248/489; 248/451

(58) Field of Classification Search ..... 40/790–793, 40/647, 611.01, 611.02, 611.11, 611.12, 40/658, 777, 361; 248/229.1, 316.1, 316.7, 248/489, 451

See application file for complete search history.

(56) References Cited

U.S. PATENT DOCUMENTS

| | | | | |
|---|---|---|---|---|
| 4,580,361 | A * | 4/1986 | Hillstrom et al. | 40/603 |
| 4,702,025 | A * | 10/1987 | Mace | 40/793 |
| 6,061,882 | A * | 5/2000 | Otte-Wiese | 24/487 |

* cited by examiner

*Primary Examiner* — Lesley D. Morris
*Assistant Examiner* — Syed A Islam
(74) *Attorney, Agent, or Firm* — Don Halgren

(57) ABSTRACT

A thin, graphic support assembly comprising an elongated base rail and an elongated cover rail which come together around a board to form four sides of a frame. A spring mechanism is fully captured after the base rail and cover rail are assembled together, and the angle and position of the spring channel allows the hinge location to be at the top/outer edge of the frame. The elongated base rail and elongated cover rail can be oriented in a parallel relationship when closed for capturing a display panel or a perpendicular relationship when open for inserting or removing a display panel.

13 Claims, 9 Drawing Sheets

FRONT LOADING FRAME DISPLAY ARRANGEMENT

BACKGROUND OF THE INVENTION

1. Field of the Invention

The present convention comprises a display arrangement constructed from a set of extruded rails which when assembled provide a thin rectangular frame which may be loaded from its front side, after it is completely assembled.

2. Prior art

In the retail industry it is often necessary to display a graphic surface in close proximity to other graphic displays. Further, those graphic displays need to be neat, presentable and readily changeable. Additionally, those display fixtures themselves may need to be a relatively unobtrusive by themselves being minimalist. Such display fixtures would ideally be a perimeter capture frame of minimum thickness. This would permit such a display fixture or frame next to or within other fixed objects such as walls or fixtures.

It is an object of the present invention, to provide a display fixture arrangement which is minimized in its dimensions so as not to be obtrusive.

It is a further object of the present invention to provide a display fixture arrangement which may be loaded with a graphic from the front.

It is a further object of the present invention to provide a low profile display fixture arrangement with a perimeter portion which, when opened, will not interfere with any other immediately adjacent fixture arrangements.

It is a further object of the present invention to provide a low profile display fixture arrangement that contains a spring mechanism that is fully contained in a minimal, angled relationship with respect to the display piece and its peripheral display biasing cover rail.

BRIEF SUMMARY OF THE INVENTION

The present invention comprises a graphic display fixture which in its most preferred embodiment would comprise a full perimeter frame for that graphic. Each side of the frame is comprised of an elongated extruded cover rail and an elongated extruded base rail of generally equal length to the cover rail. The cover rail has an elongated edge portion which pivotably mates with an elongated channel on one long edge of the base rail.

The cover rail comprises an elongated planar portion having one elongated flat side/edge thereon generally tangent to an elongated generally "J" shaped hinge portion defining the other elongated edge thereof. The hinge portion of the cover rail comprises an elongated cover-rail toe consisting of the distalmost portion of the hinge of the cover rail. An elongated pivot arm extends from a segment of the cover-rail toe at a preferably slightly obtuse angle with respect thereto. An elongated slot is formed between the elongated total and the "J" shaped hinge portion of the cover rail. An elongated shoulder extends along the length of the elongated cover rail at a portion of the underside of the elongated plane portion immediately adjacent to the "J" shaped hinge portion, to define an elongated gap between the distal end of the cover-rail toe and the elongated shoulder thereon. The cover rail itself may have decorative surface options, however, only a relatively flat shape as consistent with the present invention, prevents interference of the cover rail with adjacent objects or other neighboring frames.

The elongated base rail comprises an elongated planar portion having an "L" shaped corner bracket capture flange integral to and generally adjacent a first elongated edge thereof forming a corner bracket capture channel. The elongated base rail has an elongated upstanding flange extending along a second elongated edge thereof. An angled wall extends away from the planar portion of the base rail at a location intermediate the elongated flange on the second end of the base rail and the L-shaped corner bracket-capture flange thereon. The angled wall and the elongated flange on the second edge of the base rail define an open elongated channel therebetween. A base rail support flange or lip extends off of the angled wall and is arranged parallel to the planar portion of the base rail. A generally "J" shaped cover-rail-engagement flange extends off of the other side of the angled wall from which the base rail lip or support flange extends.

In the assembly of one side of a graphic display fixture, such as a rectilinear frame, the generally "J" shaped hinge portion of the elongated cover rail is slid into the elongated channel which extends along the second edge of the elongated base rail. The cover-rail-engagement flange is shaped so as to slide into and be received in the elongated slot between the pivot arm of the cover rail and the "J" shaped portion of that cover rail.

An elongated wave-shaped spring is inserted between the outer edge of the cover rail shoulder and the inner surface of the elongated open channel and the base rail. The elongated wave spring comprises a thin alternating form of waves having an alternating series of crests and troughs. A ridge is arranged across the midpoint on the upper edge side of the crest along the length of the elongated wave spring. The outer edge of the cover rail toe is in frictional, biased engagement with those series of ridges spaced along the length of the wavy spring.

A backer board may be placed within the assembly of the cover rail and the base rail, wherein the backer board is placed adjacent the corner bracket capture flange and beneath the base rail lip. A display panel is intended to be supportively arranged on the outermost surface of the base rail lip. Pivoted movement of the elongated planar portion of the cover rail, from an orientation perpendicular to the base rail, into a contacting or at least a retaining relationship with the display panel on the base rail, establishes the holding of that display panel within the fixture device of the frame assembly.

Four of these assemblies of cover rails and base rails, which each supports an edge of the backer board, may be joined together at the corners by a corner bracket. The corner bracket has a pair of arms which extend perpendicularly from each other. In one embodiment, the rails are cut shorter and an additional "corner block" may be used to soften the sharp edges of the miter cut with a central corner piece. Thus the use of four side assemblies of graphic support fixtures permit a graphic display panel to be installed within that assembly from the front without having to remove that assembly from a wall or a crowded support position.

The invention thus comprises a thin, graphic support assembly comprising; an elongated base rail having an elongated first edge and an elongated second edge; an elongated cover rail having an elongated planar portion arranged along one edge thereof, and an elongated "J" shaped portion tangentially arranged along a second edge thereof; an elongated receiving channel arranged in the elongated second edge of the base rail, with a biasing member arranged therein, the elongated "J" shaped portion of the cover rail hingedly arranged also with the elongated receiving channel, to permit the cover rail to be pivoted about its "J" shaped portion so as to enable the graphic support assembly to retain a display panel between the cover rail and the base rail. Thus, the two "J"-shaped elongated, slidingly engaged "flanges" comprises the elongated pivot axis relationship between the cover rail and the base rail.

The invention also comprises a method of supporting a graphic display in a graphic support assembly, comprising one or more of the following steps, including: extruding an elongated base rail having an elongated first edge and an elongated second edge; extruding an elongated cover rail having an elongated planar portion arranged along one edge thereof, and an elongated "J" shaped portion arranged along a second edge thereof; forming an elongated receiving channel arranged in the elongated second edge of the extruded base rail; inserting a biasing member into the elongated receiving channel; inserting the elongated "J" shaped portion of the cover rail into the elongated receiving channel, to permit the cover rail to be hingedly pivoted about its "J" shaped portion; placing a display panel onto a support lip or flange of the base rail; and pivoting the cover rail about its biased-member-engaged elongated "J" shaped portion and into close relationship with the support lip or flange of the base rail, so as to enable the graphic support assembly to retain the display panel between the cover rail and the base rail.

The invention thus comprises a thin, graphic support assembly comprising; an elongated base rail having an elongated first edge and an elongated second edge; an elongated cover rail having an elongated planar portion arranged along one edge thereof, and a tangentially adjacent elongated "J" shaped portion arranged along a second edge thereof, the elongated cover rail pivotable between an open orientation and a closed graphic or panel restraining position; an elongated receiving channel arranged in the elongated second edge of the base rail, with a biasing member arranged therein, the elongated "J" shaped portion of the cover rail hingedly arranged also with the elongated receiving channel, to permit the cover rail to be pivoted about its "J" shaped portion so as to enable the graphic support assembly to retain a display panel between the cover rail and the base rail; the pivot axis located between the "J" shaped portion of the cover rail and the "J" shaped upper edge of the receiving channel in the base rail. The elongated receiving channel is preferably arranged obliquely with respect to the base of the base rail. The biasing member preferably comprises an elongated sinusoidally shaped spring. The elongated sinusoidally shaped spring preferably lies beneath the cover rail. The elongated base rail has an elongated lip or flange for support of a graphic or panel thereon. The graphic or panel supported on the elongated lip of the base rail may in one embodiment have a free space between it and the cover rail when the cover rail is in the closed graphic or panel restraining orientation, depending however, upon the thickness of the graphic or panel. The assembly may also include a backer board supported by a lip of the base rail and a corner bracket capture flange of the base rail. A free space may also be arranged between the graphic or panel and the backer board. The "J" shaped portion of the cover rail preferably includes an elongated rail toe and an elongated pivot arm. The elongated cover rail toe and the elongated pivot arm are preferably arranged at an obtuse angle with respect to one another on the distalmost portion of the "J" shaped portion of the cover rail. The elongated cover rail toe is in biased, frictional contact with the biasing member in the elongated receiving channel. The frictional contact of the elongated rail toe and the biasing member is preferably against a plurality of spaced apart ridges on the biasing member. The upper "J" shaped engagement flange of the base rail mates, in the elongated chamber, with an inner side of the "J" shaped edge of the cover rail, as a opening-movement-limiting member for the cover rail.

The invention also comprises a method of supporting a graphic display in a graphic support assembly, comprising one or more of the following steps which include: extruding an elongated base rail having an elongated first edge and an elongated second edge; extruding an elongated cover rail having an elongated planar portion arranged along one edge thereof, and an elongated "J" shaped portion tangentially arranged along a second edge thereof; forming an elongated receiving channel arranged in the elongated second edge of the extruded base rail; inserting a biasing member into the elongated receiving channel; inserting the elongated "J" shaped portion of the cover rail into the elongated receiving channel, to permit the cover rail to be hingedly pivoted about its "J" shaped portion; placing a display panel onto a support lip of the base rail; and pivoting the cover rail about its biased-member-engaged elongated "J" shaped portion and into close relationship with the support lip of the base rail, so as to enable the graphic support assembly to retain the display panel between the cover rail and the base rail, wherein the biased member is widthwise-arranged at an oblique angle (with respect to the plane of the graphic and the lowermost surface of the base rail) within the elongated receiving channel, wherein a free space is may be maintained between the cover flange and the graphic or panel being restrained thereby, (depending upon the thickness of the graphic or panel), and wherein a free space is preferably maintained however, between the graphic or panel supported on the base rail and a backer board supported by the base rail, The invention also comprises an elongated graphic support assembly, for supporting a planar graphic in a crowded space, comprising: an elongated base rail having an elongated support flange for supporting an edge of a graphic, the elongated base rail having an upper "J" shaped edge in planar alignment with the elongated support flange; an elongated cover rail having a "J" shaped edge in pivotable co-axial alignment with the upper "J" shaped edge of the base rail to provide a pivotable retaining member for a graphic supported on the elongated support flange. The upper "J" shaped flange of the base rail and an elongated flange on a second edge of the base rail define an elongated channel therebetween which preferably encloses the pivot axis of the assembly. The elongated channel preferably has an elongated, curvilinearly shaped bias spring therein, to provide frictional engagement with the elongated "J" shaped edge of the cover rail.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
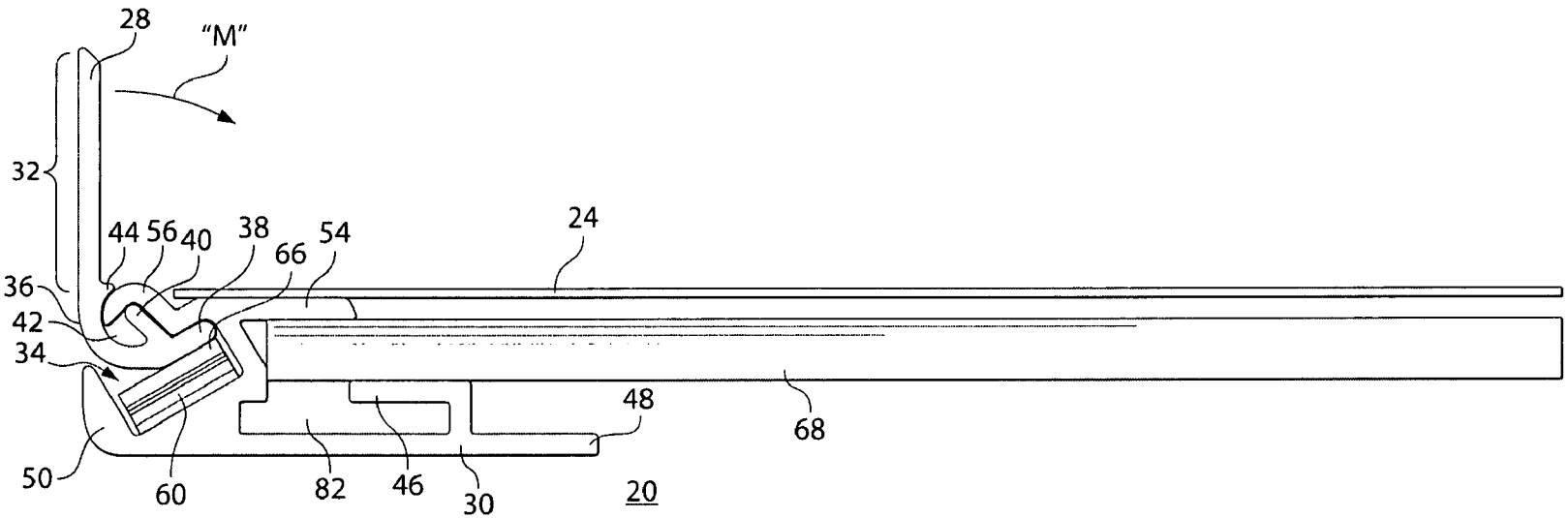
FIG. 1 is a side elevation view of an elongated cover rail, an elongated base rail and an elongated wave spring assembled together with one side of a backer board and a display panel with the elongated cover rail fully opened in its graphic-receiving orientation.
Figure 2:
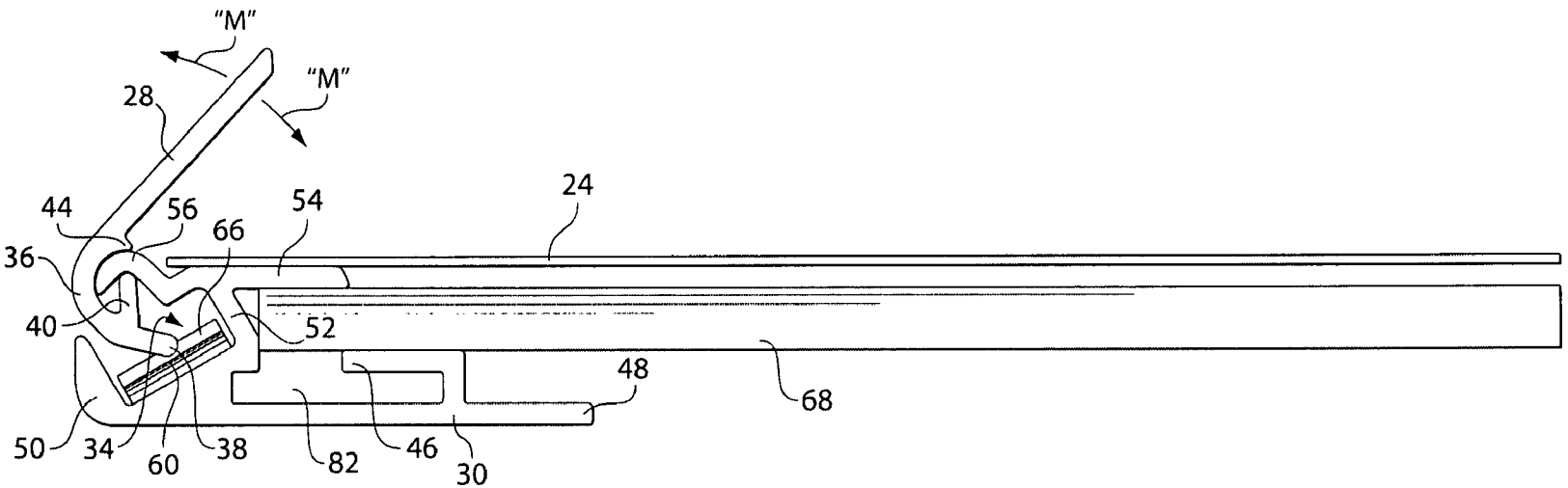
FIG. 2 is a side elevation view similar to FIG. 1, showing the elongated cover rail pivoted partially towards the elongated rail lip on the base rail.
Figure 3:
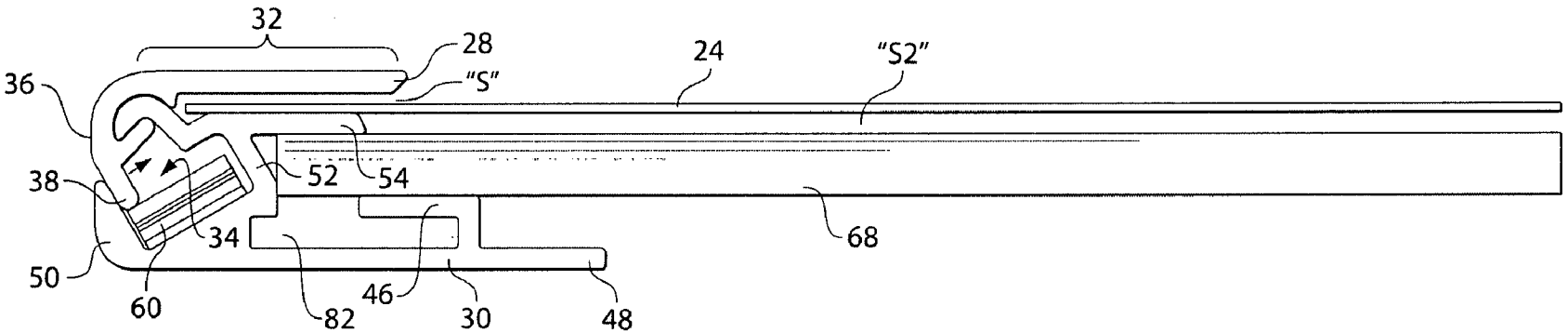
FIG. 3 is a side elevation view similar to FIG. 2 showing the elongated cover rail pivoted down into graphic-display-panel-engaging relationship relative to the base rail lip.
Figure 6:
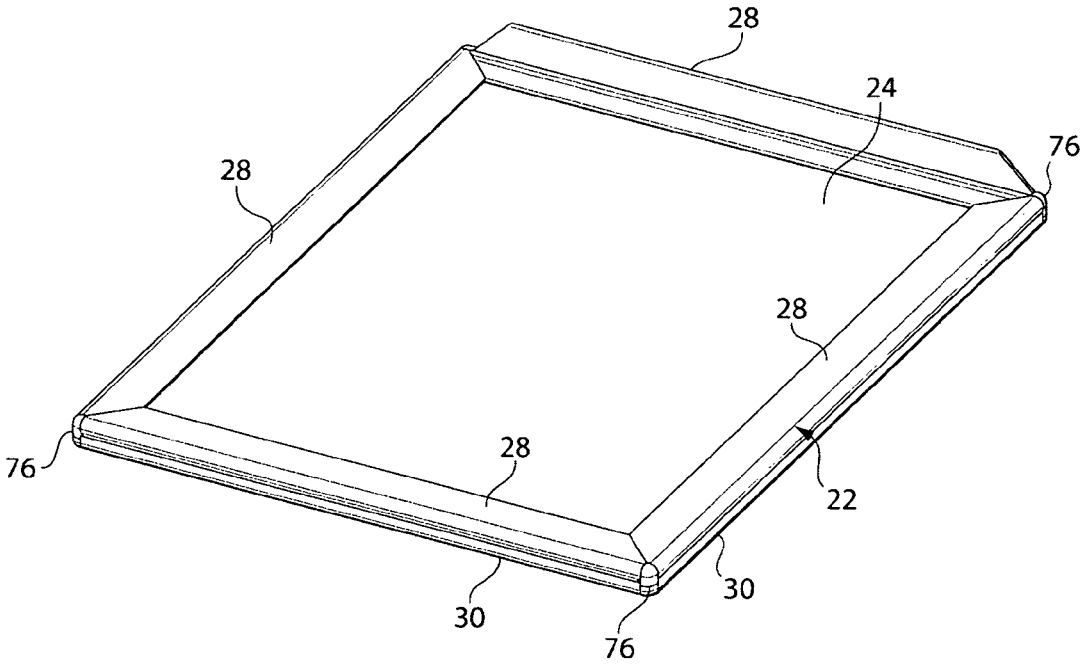
FIG. 6 is a perspective view of a frame assembly enclosing a display panel.

Referring now to the drawings in detail, and particularly FIGS. 1, 2 and 3, there is shown the present invention which comprises a graphic display fixture 20 which in its most preferred embodiment would comprise a full perimeter frame 22 for a graphic display 24, as shown in FIG. 6. Each side portion of the frame 22 is comprised of an elongated extruded cover rail 28 and an elongated extruded base rail 30, which is preferably of equal length to the cover rail 28, as represented in FIGS. 1-3. The cover rail 28 has an elongated "J" shaped edge 36 which pivotably mates within an elongated, oblique channel 34 on one long edge of the base rail 30, as is represented in end views, by FIGS. 1, 2 and 3.

Figure 5:
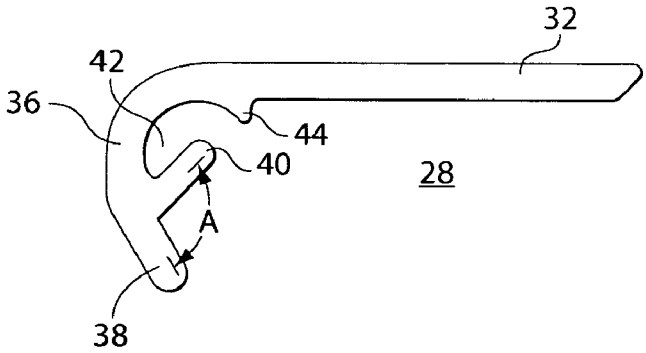
FIG. 5 is an end view of the elongated cover rail.

The cover rail 28 also comprises an elongated planar side portion 32 which defines one elongated edge thereof, and it appears "tangentially" to its elongated generally "J" shaped hinge portion 36, which defines the other elongated edge or side thereof. The hinge portion 36 of the cover rail 28 includes an elongated cover-rail toe 38 consisting of the distalmost portion of the hinge of the cover rail 28. An elongated pivot arm 40 extends from a segment of the cover rail toe 38 at a slightly obtuse angle "A" with respect thereto, as best represented in FIG. 5. An elongated slot 42 is formed between the elongated pivot arm 40 and the "J" shaped hinge portion 36 of the cover rail 28, as also shown in FIG. 5. An elongated shoulder 44 extends along the length of the elongated cover rail 28 at a portion of the underside of the elongated plane portion 32 immediately adjacent to the "J" shaped hinge portion 36.

Figure 4:
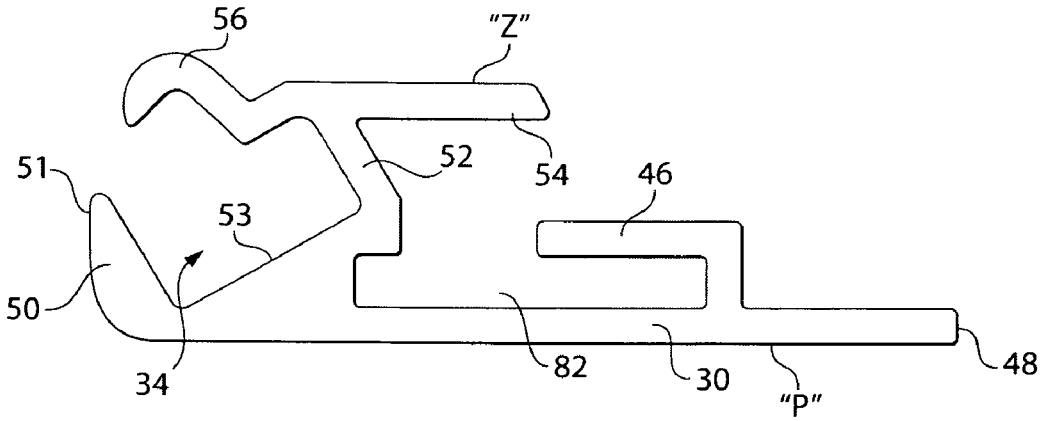
FIG. 4 is an end view of the elongated base rail.

The elongated base rail 30 comprises an elongated planar portion having an "L" shaped corner bracket-capture flange 46 integral to and generally adjacent a first elongated edge 48 thereof, the capture flange 46 partially defining an elongated bracket channel 82, as shown in FIGS. 1-4. The elongated base rail 30 has an elongated upstanding flange 50 extending along a second elongated edge thereof. The surface 51 of the flange 50, shown in FIG. 4, is in co-planar alignment with the planar side portion 32 of the cover rail 28, when the cover rail 28 is in its full open orientation, as represented in FIG. 1 and in FIG. 10A. An angled wall 52 extends away from the planar portion of the base rail 30 at a location intermediate the elongated flange 50 on the second elongated end of the base rail 30 and the L-shaped corner bracket capture flange 46 thereon, as best represented in FIG. 4. The angled wall 52 and the elongated flange 50 on the second edge of the base rail 30, and an oblique spring support base 53, best represented in FIG. 4, defines the open, elongated, oblique channel 34 therebetween. The spring support base 53 lies in a plane which is oblique to the plane "P" of the base rail 30, as shown in FIG. 4. A base rail support flange or lip 54, for peripherally supporting a graphic or panel 24, as shown in FIGS. 1, 2 and 3, extends off of the angled wall 52, and is also arranged parallel to the plane "P" of the base rail 30, as represented in FIG. 4. A somewhat "J" shaped cover engagement upper flange 56 extends off of the other side of the angled wall 52 of elongated base rail 30, in generally co-planar alignment with, and from which the base rail lip 54 extends, as may be seen in FIGS. 1-4.

In the assembly of one side of a graphic display fixture 20, such as a rectilinear frame 22, as is shown in FIG. 6, the generally "J" shaped hinge portion 36 of the elongated cover rail 28 is slid into the elongated, oblique channel 34 which extends along the second edge of the elongated base rail 30. The upper "J" shaped cover engagement flange 56 is shaped so as to slide into and be received in the elongated slot 42 between the pivot arm 40 of the cover rail 28 and the "J" shaped portion 36 of that cover rail 28, as may be seen in FIGS. 1, 2 and 3 to define an elongated pivot axis relationship therewithin.

Figure 7:
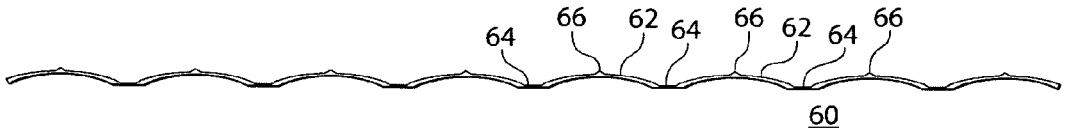
FIG. 7 is a side elevation view of an elongated wave spring utilized with the present invention.
Figure 8:
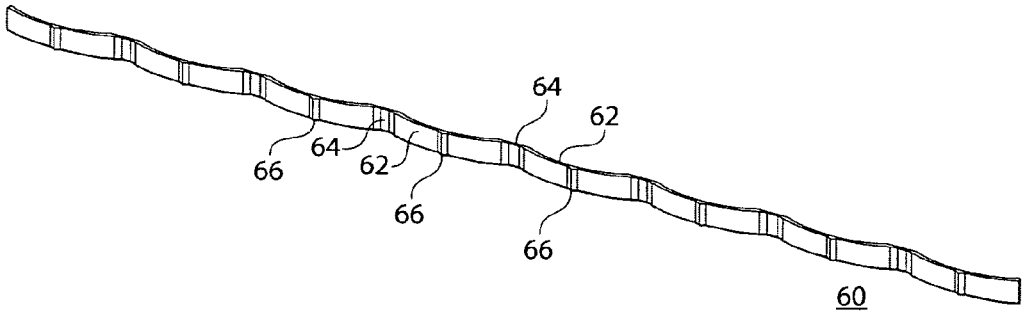
FIG. 8 is a perspective view of the elongated wave spring shown in FIG. 7.

An elongated wave shaped spring 60, as represented in FIGS. 6 and 7, is inserted between the outer edge of the cover rail toe 38 and the oblique inner surface spring support base 53 of the elongated, oblique, open channel 34 of the base rail 30, as represented in FIGS. 1, 2 and 3. The elongated wave spring 60, which itself is thus widthwise enclosed in an oblique orientation with respect to the plane "P", supported "beneath" the graphic or panel 24, and comprises a thin alternating form of waves having an alternating series of crests 62 and troughs 64. A ridge 66 is arranged transversely across the midpoint on the upper edge of the crest 62 along the length of the elongated wave spring 60, as may be seen in FIGS. 6 and 7. The outer edge of the cover rail toe 38 is in frictional biased engagement with those series of ridges 66 spaced along the length of the wavy spring 60, as is shown in FIGS. 1, 2 and 3.

A backer board 68 may be placed within the assembly of the cover rail 28 and the base rail 30 wherein the backer board 68 is placed adjacent the corner bracket capture flange 46 and beneath the base rail lip 54 parallel thereto, as shown in FIGS. 1, 2 and 3. A display graphic or panel 24 is intended to be arranged on the outermost surface of the base rail lip 54. Pivoted movement, (as indicated by the arrow "M" in FIGS. 1 and 2), of the elongated planar side portion 32 of the cover rail 28, from an orientation perpendicular to the base rail 30, as represented in FIG. 1, moving through the orientation shown in FIG. 2, and into a restraining, preferably slightly spaced apart (as defined by thin space "S" represented in FIG. 3) relationship, with (and depending upon the thickness of) the display piece panel 24 on the base rail lip 54, establishing the holding of that display piece panel 24 within the fixture device 20 of the frame assembly 22. A further planar space S2 is also shown in an edge view, in FIG. 3, may be provided between the panel/graphic 24 and a backer board 68, so as to provide a limited flexibility to the panel 24 when it is necessary to get easy access to the inner edge of the cover rail 28, for replacement of that graphic/panel 24.

Figure 9:
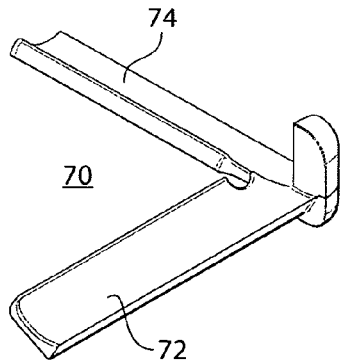
FIG. 9 is a perspective view of a corner block utilized to soften sharp corners of the miter cut cover rail and the miter cut base rail.
Figure 10A:
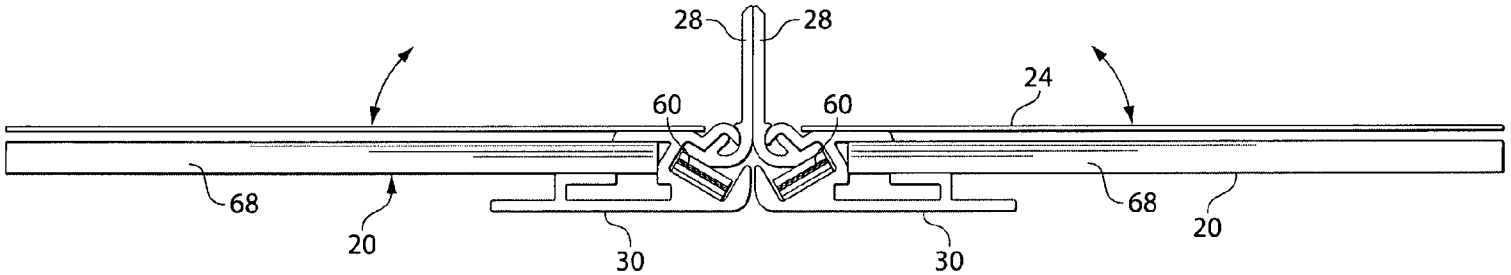
FIG. 10A is a side elevation view of a pair of base and cover rails back-to-back in the fully open display receiving orientation.
Figure 10B:
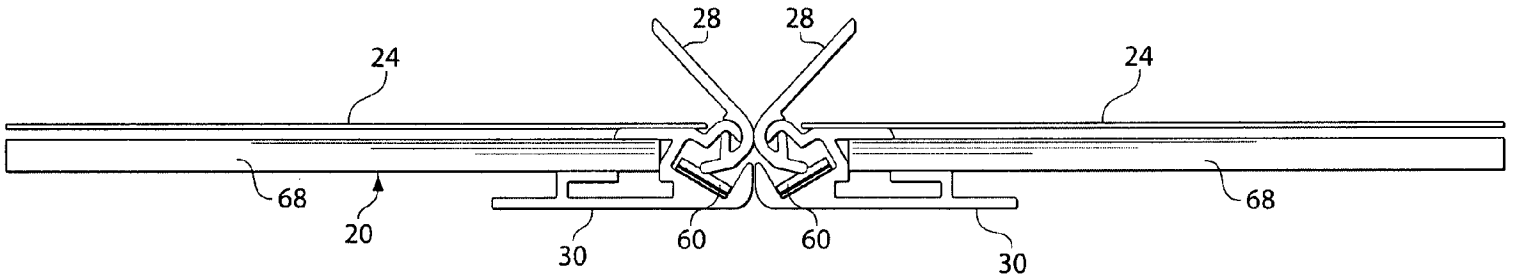
FIG. 10B is a side elevation of view of the pair of base and cover rails shown in FIG. 10A, with the cover rail in a partially closed orientation.
Figure 10C:
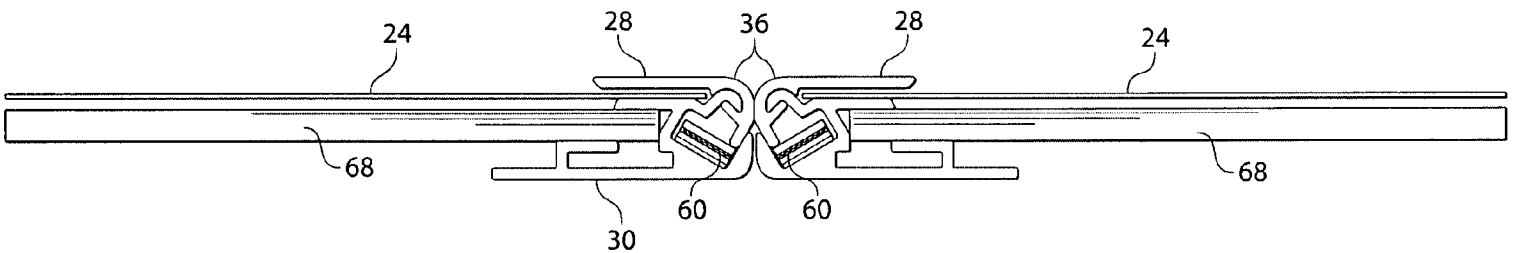
FIG. 10C is a side elevation view of the pair of base and cover rails back to back, with their respective cover rails fully capturing a display sheet against the base rail lip.
Figure 11A:
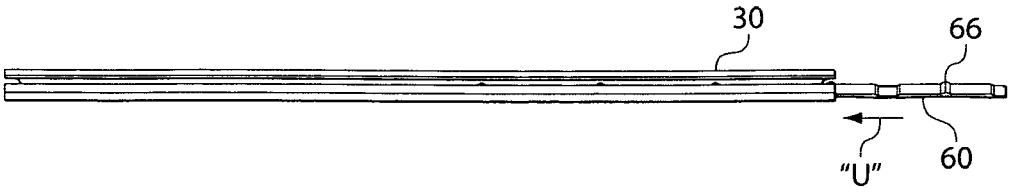
FIG. 11A is an edge view of the base rail shown in FIG. 4 receiving a biasing spring therewithin.
Figure 11B:
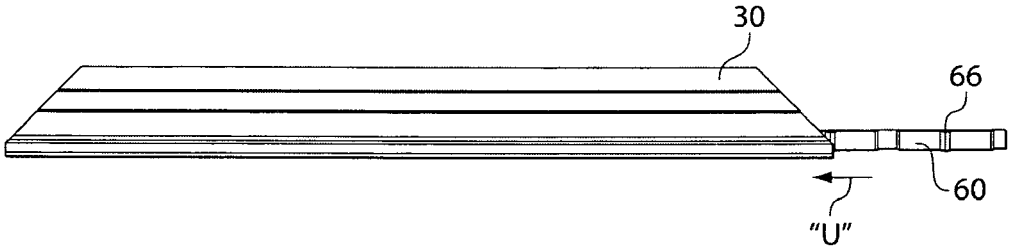
FIG. 11B is a plan view of the base rail shown in FIG. 4 receiving a biasing spring therewithin.
Figure 11C:
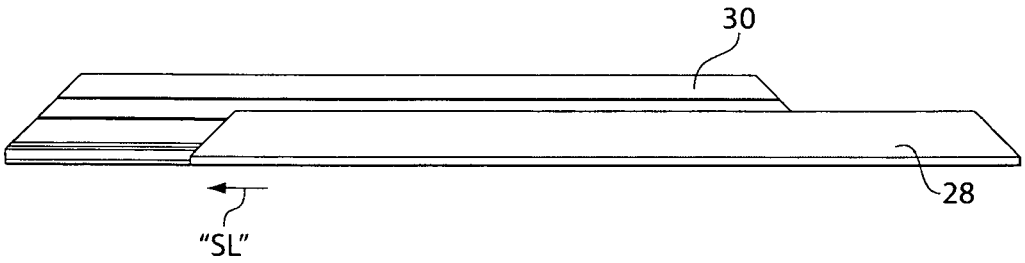
FIG. 11C is a plan view of the base rail and the cover rail being slid thereover.
Figure 11D:
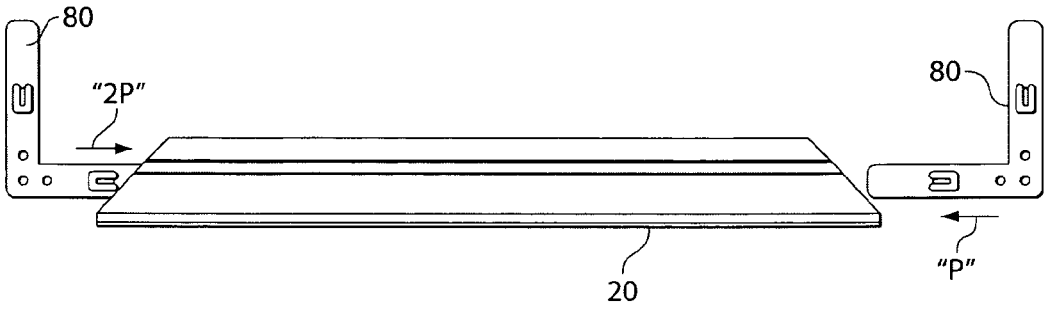
FIG. 11D is a plan view of the base rail and cover rail assembled, with a pair of corner securement brackets being slid into their respective slots at the ends of the base rail.
Figure 11E:
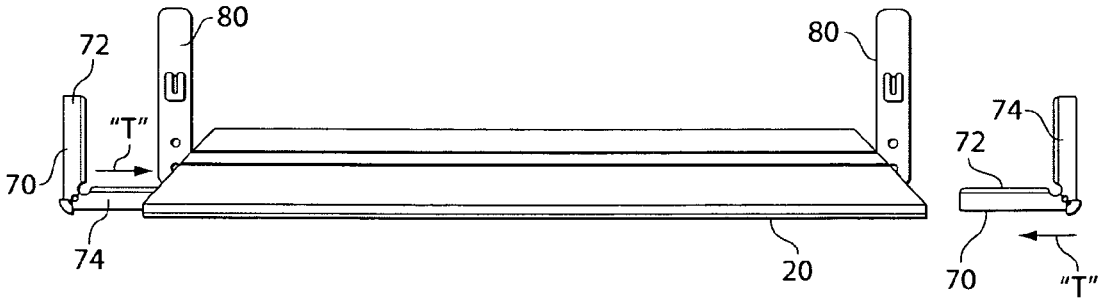
FIG. 11E is a plan view of the base rail and cover rail and corner securement brackets assembled, with a pair of corner softening corner blocks being slid into their respective ends of the base rail.

Four of these assemblies 20 of cover rails 28 and base rails 30 which each supports a common backer board 68, may be joined together at the corners by a corner bracket 80, as shown in FIGS. 11D and 11E, and by the "corner softening" corner block 70. The "corner softening" corner block 70, as represented in FIG. 9, has arms 72 and 74 which extend perpendicularly from each other, and extend into their respective end of the elongated oblique channel 34, (nesting adjacent the spring member 60, shown in FIGS. 1-4). The corner bracket 80 on the other hand, is represented in FIGS. 11D and 11E and described further hereinbelow. In one embodiment, the rails are cut shorter and the corner block 70, as shown in FIG. 9, may be used to soften the edges of miter cut rails, by a central corner piece 76, shaped so as to be inserted into the open ends of the channels 34 of the base rail 30. Thus the use of four side assemblies of graphic support fixtures 20 permit a graphic display panel 24 to be installed within that assembly from the front, as represented in FIG. 10A, and supported therein, as represented in FIGS. 10B and 10C, without having to remove that assembly 20 or frame 22 from a wall or a crowded support position. Also, adjacent cover rails 28 of adjacent frame assemblies 22 may be opened simultaneously as represented in FIGS. 10A-10C, without interfering with one another because of the oblique nesting of the spring 60 within the oblique channel 34 disposed beneath the plane "Z" of the base rail lip 54, represented in FIG. 4, which allows the elongated pivot axis to be located within the "J" shaped portion 36 of the cover rail 28 and the outer edge of the receiving channel 34 in the base rail 30, as represented in FIGS. 10A, 10B and 10C.

The steps in the assembly of a graphic display fixture 20 is presented in FIGS. 11A, 11B, 11C, 11D, and 11E. Initially, the elongated spring 60 is inserted into its respective elongated channel 34, as indicated by arrow "U", into one of the base rails 30, as represented in a side view of FIG. 11A. The same is shown in a plan view represented by FIG. 11B. The cover rail 28 is shown being slid onto the edge of the base rail 30 in FIG. 11C, as indicated by arrow "SL". Assembled base rail 30 and the cover rail 28 are shown in FIG. 11D, as receiving a pair of "L" shaped corner brackets 80.

The respect of legs on those corner brackets 80 are being inserted into the elongated slots 82 in the base rail 30, as indicated by arrows "2P". Those elongated slots 82 may be seen in an edge view in FIGS. 1, 2 and 3. The pair of corner blocks 70 are shown in FIG. 11E as being inserted into their respective ends of the elongated channel 34 as indicated by arrow "T" to complete one side of a rectangular graphic display fixture 20, as represented earlier in FIG. 6, thus providing the thin, easily openable, front loadable graphic display, usable even in crowded, side by side presentations as represented in the side views thereof in FIGS. 10A, 10B and 10C.

We claim:

1. A thin, graphic support assembly comprising;

an elongated base rail having an elongated first edge and an elongated second edge;

an elongated cover rail having an elongated planar portion arranged along one edge thereof, and an elongated "J" shaped portion arranged along a second edge thereof, the elongated cover rail pivotable between an open orientation and a closed graphic or panel restraining position;

an elongated receiving channel arranged in the elongated second edge of the base rail, with a biasing member arranged therein, the elongated "J" shaped portion of the cover rail hingedly arranged also with the elongated receiving channel, to permit the cover rail to be pivoted about its "J" shaped portion which is tangential to the "J" shaped portion of the cover rail and the outer edge of the receiving channel in the base rail, so as to enable the graphic support assembly to retain a display panel between the cover rail and the base rail; and wherein the "J" shaped portion of the cover rail includes an elongated rail toe and an elongated pivot arm, the elongated cover rail toe and the elongated pivot arm being arranged at an obtuse angle with respect to one another on the "J" shaped portion of the cover rail, wherein the elongated rail toe is in biased, frictional contact with the biasing member in the elongated receiving channel, and wherein the frictional contact of the elongated cover rail toe and the biasing member is against a plurality of spaced-apart ridges on the biasing member.

2. The graphic support assembly as recited in claim 1, wherein the elongated receiving channel is arranged obliquely with respect to the base rail.

3. The graphic support assembly as recited in claim 1, wherein the biasing member comprises an elongated sinusoidally shaped spring.

4. The graphic support assembly as recited in claim 3, wherein the elongated sinusoidally shaped spring lies beneath the cover rail.

5. The graphic support assembly as recited in claim 1, wherein the elongated base rail has an elongated lip for support of a graphic or panel thereon.

6. The graphic support assembly as recited in claim 5, wherein an engagement flange of the base rail mates in the elongated channel, with an inner portion of the "J" shaped edge of the cover rail, as a movement-limiting member for the closing of the cover rail.

7. The graphic support assembly as recited in claim 5, wherein the graphic or panel supported on the elongated lip of the base rail has a free space between it and the cover rail, when the cover rail is in the closed graphic or panel restraining orientation.

8. The graphic support assembly as recited in claim 5, including a backer board supported by the lip of the base rail and a corner bracket capture flange of the base rail.

9. The graphic support assembly as recited in claim 8, wherein a free space is arranged between the graphic or panel and the backer board.

10. A method of supporting a graphic display in a graphic support assembly, comprising:

extruding an elongated base rail having an elongated first edge and an elongated second edge;

extruding an elongated cover rail having an elongated planar portion arranged along one edge thereof, and an elongated "J" shaped portion arranged along a second edge thereof;

forming an elongated receiving channel arranged in the elongated second edge of the extruded base rail;

inserting an elongated, sinusoidally-shaped biasing member having cover rail engaging-ridge-portions into the elongated receiving channel;

inserting the elongated "J" shaped portion of the cover rail into the elongated receiving channel, to permit the cover rail to be hingedly pivoted about its "J" shaped portion;

placing a display panel onto a support lip of the base rail; and pivoting the cover rail about its biased member-engaged elongated "J" shaped portion and into close relationship with the support lip of the base rail, so as to enable the graphic support assembly to retain the display panel between the cover rail and the base rail.

11. The method as recited in claim 10, wherein the biased member is arranged at an oblique angle within the elongated receiving channel.

12. The method as recited in claim 11, wherein a free space is maintained between the cover rail and the graphic or panel being restrained thereby.

13. The method as recited in claim 11, wherein a free space is maintained between the graphic or panel supported on the base rail and a backer board supported by the base rail.

* * * * *